United States Patent [19]

Cole

[11] 4,177,535

[45] Dec. 11, 1979

[54] POLISHING APPARATUS

[76] Inventor: Bernie R. Cole, 2930 Adams, San Diego, Calif. 92116

[21] Appl. No.: 930,532

[22] Filed: Aug. 2, 1978

[51] Int. Cl.[2] ..... A47L 11/12

[52] U.S. Cl. ..... 15/97 R; 15/28; 51/170 T

[58] Field of Search ..... 15/28, 29, 97 R, 98, 15/49 R, 50 R; 51/170 R, 170 T, 170 TL, 170 MT

[56] References Cited

U.S. PATENT DOCUMENTS

| | | | |
|---|---|---|---|
| 2,597,971 | 5/1952 | Burnham | 15/28 X |
| 2,967,315 | 1/1961 | Helbig et al. | 15/49 R |
| 3,448,476 | 6/1969 | Zaccone | 51/170 T |
| 3,579,915 | 5/1971 | Satterthwaite | 51/170 T X |

FOREIGN PATENT DOCUMENTS

| | | | |
|---|---|---|---|
| 910146 | 3/1954 | Fed. Rep. of Germany | 51/170 T |
| 474334 | 9/1952 | Italy | 15/29 |

*Primary Examiner*—Edward L. Roberts
*Attorney, Agent, or Firm*—Charles C. Logan, II

[57] ABSTRACT

A portable polishing apparatus having an electric motor with a housing, a polishing wheel assembly detachably secured to the lower end of the electric motor shaft, and a handle grip secured to the electrical motor housing. The handle grip is in the form of a steering wheel with its arms secured to the motor housing that is positioned within the perimeter of the steering wheel. The center of gravity of the polishing apparatus lies below the horizontal plane of the steering wheel thereby causing the polishing apparatus to automatically right itself any time a tipping force is removed therefrom. The steering wheel has an outer diameter greater than the diameter of the polishing wheel assembly thus facilitating the tilting of the polishing apparatus when desired. The polishing assembly has an eccentric orbital member and a polishing wheel.

3 Claims, 3 Drawing Figures

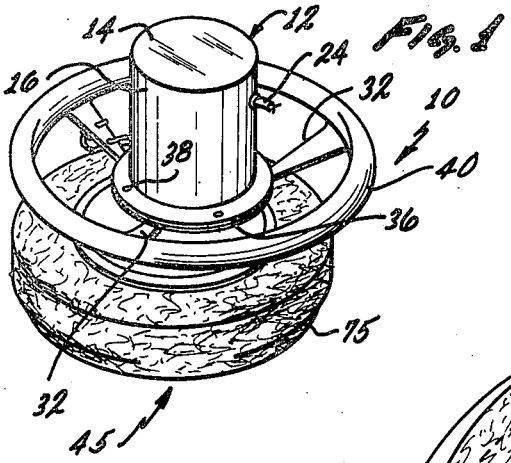
FIG. 1
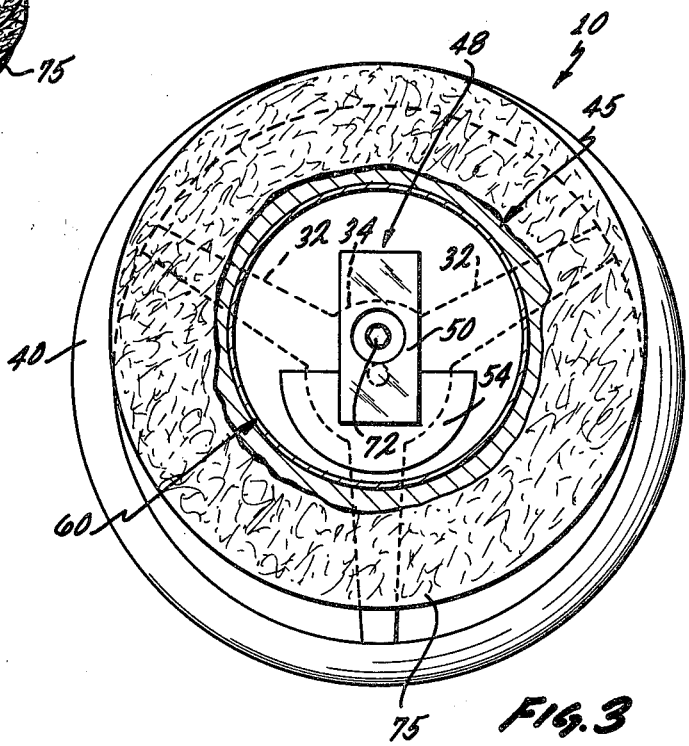
FIG. 3
FIG. 2
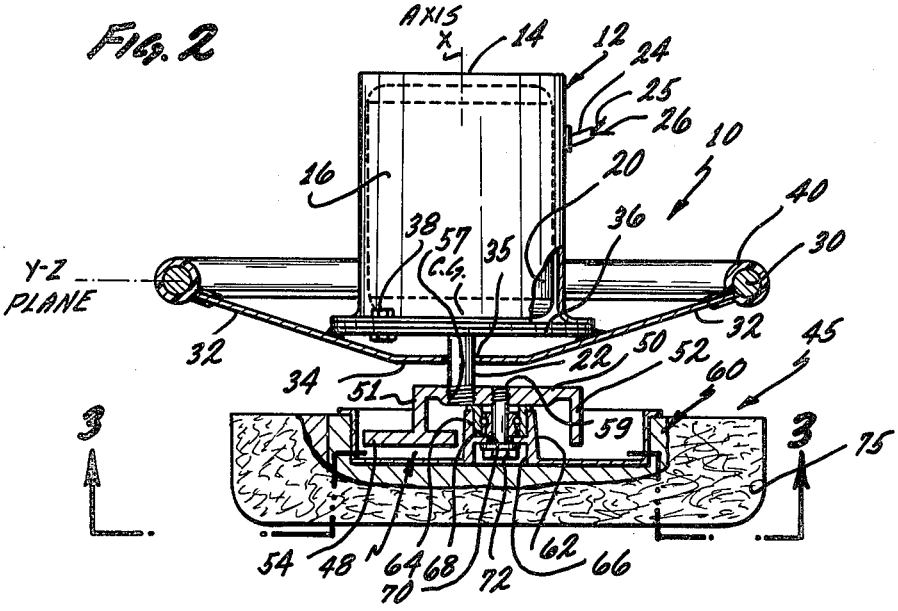

POLISHING APPARATUS

BACKGROUND OF THE INVENTION

This invention relates to polishing machines generally and more particularly to portable motorized polishers suitable for polishing automobiles as well as for a great variety of household and industrial uses.

In the past portable polishing devices have been manufactured in various designs. Essentially each of these has had an electric motor mounted in a housing and having a polishing wheel attached to the lower end of the electric motor drive shaft. A few examples of this type of structure are illustrated in U.S. Pat. Nos. 2,379,997, 2,443,023, and 3,084,364. In each of these polishing devices a handle for holding or gripping the device has been mounted to extend laterally outwardly from only one side of the electric motor housing. This type of gripping handle has not been convenient for applying greater pressure to the polishing wheel on the surface being polished. There is a tendency with this type of a handle or grip for the polishing device to try to squirt out from under the control of the user. Also the polishing wheel of the polishing devices referred to above in the United States Patents, only rotate about the shaft of the electric motor and this can cause distinct spots to be formed on the surface being polished.

Some other prior art portable polishing devices are illustrated in U.S. Pat. Nos. 2,014,119, and 2,542,158. These polishing devices have been designed with the handle located above the device so that varying degrees of pressure can be applied to the polishing wheel while it is being applied to the surface to be polished. The location of the gripping handle above the device has necessitated the use of suitable gearing on the electric motor shaft to drive a second shaft oriented 90° to the electric motor shaft. Both of the polishing devices illustrated in these patents only have the polishing wheel rotating about a driven shaft perpendicular thereto.

It is an object of the invention to provide a portable polishing device primarily adapted to eliminate the great amount of motion performed by the arm of the person polishing an automobile by means of a cloth held in the hand, and thus eliminate the consequent fatigue.

It is also an object of the invention to provide a portable polishing device of simple design and having few parts.

It is also an object of the invention to provide a portable polishing device that may be manufactured economically and is highly efficient in operation.

It is a further object of the invention to provide a portable polishing device whose center of gravity is so located that the polishing device will automatically right itself anytime a tipping force is removed.

It is a further object of the invention to provide a polishing device that can be easily tipped or tilted to follow a curved contour surface that needs to be polished.

It is a further object of the invention to provide a portable polishing device having handle grip structure that can be gripped simultaneously on opposite sides of the polishing device.

It is an additional object of the invention to provide a portable polishing device having an eccentric orbital polishing motion.

It is an additional object of the invention to provide a portable polishing device whose handle gripping structure facilitates the application of greater pressure on the polishing device against the surface being polished.

SUMMARY OF THE INVENTION

The portable apparatus for polishing has an electric motor having a drive shaft, a polishing wheel assembly detachably secured to the lower end of the electric motor shaft, and handle gripping structure secured to the electrical motor housing. The electric motor housing has a top wall and side walls with the motor shaft extending from the bottom of the housing. A flange adjacent the bottom of the side walls extends outwardly at approximately a 90° angle.

The handle grip structure is in the form of a steering wheel with its spoke arms secured to the motor housing. This is accomplished by use of a ring that is welded or otherwise attached to the spoke arms and this ring is in turn bolted to the flange formed on the bottom of the side walls of the housing. The steering wheel lies in a horizontal plane substantially perpendicular to the longitudinal axis of the electric motor. The plane within which the steering wheel lies is oriented between a plane drawn perpendicular to the top wall of the motor housing and a plane drawn perpendicular to the bottom of the side walls of the motor housing. The center of gravity of the polishing apparatus lies below the horizontal plane passing through the steering wheel thereby causing the polishing apparatus to automatically right itself anytime a tipping force is removed. The spoke arms of the steering wheel radiate outwardly and upwardly from the motor housing to allow the lateral edges of the polishing wheel assembly to be tilted or directed into unusual and different contoured surfaces that require polishing. The steering wheel has an outer diameter greater than the diameter of the polishing wheel assembly thus facilitating the tilting of the polishing apparatus when desired.

The polishing wheel assembly comprises an eccentric orbital member and a polishing wheel. The eccentric orbital member has an elongated plate having a first threaded bore located perpendicular to the bottom surface of the plate. This first threaded bore is substantially symmetrically centered on the plate. A pair of legs depend downwardly from the opposite ends of the elongated plate. A foot of substantial mass is formed on the bottom of one of the legs and this foot is oriented substantially perpendicular to the leg and has a shape similar to a half moon. A second threaded bore is located perpendicular to the top surface of the plate but it is located eccentrically with respect to the center of the plate in the lower end of the motor shaft is threadably received in the second threaded bore.

The polishing wheel has a hub at its center with counter sunk recesses in its opposite lateral sides. A ball bearing assembly is received in the top recess. The center of the hub also has an aperture that connects with the top and bottom recesses and a bolt having a smooth shank portion passes through this aperture with its head encaptured in the bottom recess and the smooth shank portion being journaled within the ball bearing assembly. The threaded tip portion on the bolt is threadably received in the first threaded bore on the bottom of the elongated plate. It will be easily understood that as the motor shaft rotates, the eccentric orbital member will be driven in a rotating manner about the motor shaft. At the same time the polishing wheel will rotate in a free-wheeling manner about the bolt securing the polishing wheel to the eccentric orbital member. The resulting motion given to the polishing pad will be an orbital motion thus preventing undue wear or damage to the surface being polished.

DESCRIPTION OF THE DRAWINGS

FIG. 1 is a prospective view of the novel polishing apparatus;

FIG. 2 is a side elevation view of the novel polishing apparatus with portions being shown in cross-section; and FIG. 3 is a bottom view of the novel polishing apparatus with portions of the structure broken away along the lines 3—3 of FIG. 2.

The polishing apparatus will be described by referring to FIGS. 1-3. The polishing apparatus is generally designated numeral 10. It has a motor housing 12 having a top wall 14, side walls 16, and a flange formed at the bottom of the side walls. The motor 20 is supported within the housing 12 and has a shaft 22 extending downwardly along the x-axis. The power cord 24 has conductor wires 25 and 26 that would be connected with a suitable source of the electric power.

The gripping wheel handle 30 is oriented in the y-z plane. This plane is located above the center of gravity C.G. of the polishing apparatus. A plurality of spoke arms 32 extend outwardly and upwardly from a disc 34 with their outer ends secured to the gripping wheel handle 30. The disc 34 has an aperture 35 through which passes the electric motor shaft 22. A ring 36 is welded or otherwise suitably connected to the spoke arms 32. A plurality of bolts 38 connect flange 18 of the electric motor housing to the ring 36. The outer surface of the gripping wheel handle 30 has a resilient cover 40 to give it a soft grip. Alternatively the gripping wheel handle could have a gripping contour such as on the outer surface of many automobile steering wheels.

The polishing wheel assembly 45 has an eccentric orbital member 48 formed from an elongated plate 50 that has a pair of legs 51 and 52 depending downwardly from its opposite ends. A foot 54 of substantial mass is formed on the bottom of leg 51 and this foot is formed in the shape of a half moon. A threaded bore 57 is located perpendicular to the top surface of plate 50 and motor shaft 22 is threadably received therein. A threaded bore 59 is located perpendicular to the bottom surface of plate 50 and it is substantially symmetrically centered on the plate.

The polishing wheel 60 has a hub 62 at its center and it has counter sunk recesses 64 and 66 in its opposite lateral sides. A ball bearing assembly 68 is received in top recess 64. The center of hub 62 has an aperture 70 that connects with the top and bottom recesses. The bolt 72 has a smooth shank portion passing through aperature 70 with its head being captured in bottom recess 66. The smooth shank portion is also journaled within ball bearing assembly 68 with the threaded tip portion of bolt 72 being threadably received in threaded bore 59 on the bottom of elongated plate 50. A polishing pad 75 is detachably mounted on polishing wheel 60. A soft cloth cover can be mounted over polishing pad 75 for buffing polished surfaces.

What is claimed is:

1. A portable apparatus for polishing and the like comprising:

an electrical motor having a longitudinal axis, said electric motor having a housing, said housing comprising a top wall and sidewalls, said electric motor having a shaft extending from the bottom of said motor housing:

handle grip means secured to said electrical motor housing, said handle grip means being in the form of a steering wheel with at least two spoke arms whose inner ends are secured to said motor housing, said handle grip means being in a horizontal plane substantially perpendicular to the longitudinal axis of said electric motor, the plane in which said handle grip means is located being oriented between a plane drawn parallel to the top wall of said motor housing and a plane drawn parallel to the bottom of the side walls of said motor housing, the center of gravity of said apparatus being in a plane perpendicular to the longitudinal axis of said electric motor that is below said horizontal plane passing through said handle grip means thereby causing said polishing apparatus to automatically right itself any time a tipping force is removed;

a polishing wheel assembly detachably secured to the lower end of said electric motor shaft, said polishing wheel assembly being oriented to rotate in a plane substantially perpendicular to the longitudinal axis of said electric motor shaft, said polishing wheel assembly an eccentric orbital member and a polishing wheel;

said eccentric orbital member comprising:

an elongated plate having a first threaded bore located perpendicular to the bottom surface of said plate, said first threaded bore being substantially symmetrically centered on said plate, a pair of legs depend downwardly from the opposite ends of said elongated plate, a foot of substantial mass is formed on the bottom of one of said legs, said foot being formed substantially perpendicular to said leg and being in the shape of a half moon, and a second threaded bore located perpendicular to the top surface of said plate but being located eccentrically with respect to the center of said plate, said motor shaft being threadably received in said second threaded bore;

said polishing wheel having a hub at its center with counter sunk recesses in its opposite lateral sides, a ball bearing assembly is received in the top recess, the center of said hub also has an aperture that connects with the top and bottom recesses, a bolt having a smooth shank portion passes through said aperture with its head being captured in the bottom recess, said smooth shank portion is also journaled within said ball bearing assembly with a threaded tip portion on said bolt being threadably received in said first threaded bore on the bottom of said elongated plate.

2. A polishing apparatus as recited in claim 1 wherein said spoke arms radiate outwardly and upwardly from said motor housing.

3. A polishing apparatus as recited in claim 1 wherein said steering wheel has an outer diameter greater than the diameter of said polishing wheel assembly thus facilitating the tilting of said polishing apparatus when desired.

* * * * *